US010317062B2

(12) United States Patent
Speer et al.

(10) Patent No.: US 10,317,062 B2
(45) Date of Patent: Jun. 11, 2019

(54) END CAP WITH CONTACTOR EXERTING OUTWARD FORCE AND LIGHTING DEVICE HAVING SAME

(71) Applicant: LEDVANCE LLC, Wilmington, MA (US)

(72) Inventors: Richard Speer, Concord, MA (US); Kenneth Grossman, Beverly, MA (US)

(73) Assignee: LEDVANCE LLC, Wilmington, MA (US)

( * ) Notice: Subject to any disclaimer, the term of this patent is extended or adjusted under 35 U.S.C. 154(b) by 223 days.

(21) Appl. No.: 14/806,302

(22) Filed: Jul. 22, 2015

(65) Prior Publication Data

US 2017/0023224 A1 Jan. 26, 2017

(51) Int. Cl.

| | |
|---|---|
| ***F21V 23/06*** | (2006.01) |
| ***F21K 9/272*** | (2016.01) |
| ***F21V 19/00*** | (2006.01) |
| ***F21V 15/015*** | (2006.01) |
| *F21Y 103/10* | (2016.01) |

(Continued)

(52) U.S. Cl.

CPC ..... *F21V 23/06* (2013.01); *F21K 9/272* (2016.08); *F21V 15/015* (2013.01); *F21V 19/0085* (2013.01); *F21Y 2103/10* (2016.08); *F21Y 2115/10* (2016.08); *F21Y 2115/15* (2016.08)

(58) Field of Classification Search

CPC ..... H01R 4/22; H01R 4/247; H01R 4/4863; H01R 4/4872; H01R 33/06; H01R 33/0827–33/0845; H01R 33/18; H01R 33/20; H01R 33/205; H01R 33/22–33/465; H01R 33/7621; H01R 33/94; H01R 33/9453; H01R 33/9456; H01R 33/96; H01R 33/962; H01R 33/9651; H01R 33/9653; H01R 33/9655; H01R 33/9656; H01R 13/15; H01R 13/17; H01R 13/2421; H01R 13/625; F21Y 2103/10; F21K 9/23; F21K 9/235; F21K 9/237; F21K 9/27; F21K 9/272; F21K 9/275; F21K 9/278; F21V 23/06; F21V 15/015; F21V 19/0045

See application file for complete search history.

(56) References Cited

U.S. PATENT DOCUMENTS

2011/0228517 A1* 9/2011 Kawabat ..... F21K 9/00 362/84
2013/0127327 A1* 5/2013 Heil ..... F21V 25/04 313/313

(Continued)

*Primary Examiner* — Anh Mai
*Assistant Examiner* — Steven Horikoshi

(57) ABSTRACT

An end cap for a solid-state lighting device is described that provides an electrical connection(s) between an external power source and at least one solid-state emitter disposed in a hollow member of the lighting device. An outer wall extends a first distance and an inner wall extends a second distance from an inward-facing side of the end cap base. A gap between the inner wall and the outer wall accommodates the insertion of the hollow member. A contactor electrically coupled to a conductive member on an opposite side of the end cap extends into the gap. The contactor exerts a force on a flexible conductor and provides a power supply path to or power return path from the at least one solid-state emitter. Preferably, the lighting device includes an array of solid-state emitters disposed on a flexible substrate.

15 Claims, 5 Drawing Sheets

(51) Int. Cl.
*F21Y 115/10* (2016.01)
*F21Y 115/15* (2016.01)

(56) References Cited

U.S. PATENT DOCUMENTS

2015/0176770 A1* 6/2015 Wilcox ..... F21K 9/175
362/224
2015/0276139 A1* 10/2015 Rowlette, Jr. ..... F21K 9/175
362/249.06

* cited by examiner

END CAP WITH CONTACTOR EXERTING OUTWARD FORCE AND LIGHTING DEVICE HAVING SAME

TECHNICAL FIELD

The present disclosure relates to lighting devices and in particular to solid-state lighting devices designed as replacements for linear fluorescent lamps.

BACKGROUND

Fluorescent light bulbs take on a variety of shapes and sizes—from small compact fluorescent lamps (CFLs) with screw-in Edison bases that find frequent use as energy-efficient replacements for incandescent lamps to the ubiquitous 48" linear fluorescent tube used in innumerable commercial, institutional, and industrial settings. While fluorescent lighting typically provides luminous output at an energy cost that is much less than incandescent lighting, fluorescent lights contain small amounts of mercury which may pose environmental issues if large quantities of lamps are improperly disposed of at the end of life.

Given the large number of fluorescent fixtures installed in commercial, institutional, and industrial establishments, it is desirable to replace fluorescent lamps with other high efficiency, mercury-free lighting solutions having the same form factor so that replacement of the existing fixtures is not necessary. This has led to the development of solid-state replacement lamps which include arrays of light-emitting diodes (LEDs) disposed within hollow tubes. These new solid-state lamps require different construction methods than conventional fluorescent lamps and in particular different means for making electrical connections between the external electrical power connectors of fluorescent fixtures and the internal circuits that power the LEDs.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

DETAILED DESCRIPTION

Solid-state lighting devices, such as light emitting diodes (LEDs), organic light emitting diodes (OLEDs); and polymer light emitting diodes (PLEDs), provide multiple benefits that include superior illumination, reduced energy consumption, flexible installation requirements, and reduced thermal emissions. Improvements in solid-state lighting technology have included the ability to produce solid-state lighting devices such as LEDs on flexible substrates such as polyethylene terephthalate (PET) films. The inherent flexibility in such solid-state lighting devices has introduced the use of such devices in locations formerly deemed unsuitable for employment of solid-state devices. One such example is placing one or more solid-state lighting arrays on a flexible substrate positioned within a transparent hollow member such as a linear T8 tube used for fluorescent lighting. (The tube diameters of fluorescent lamps are given in increments of ⅛". Thus, a T8 fluorescent lamp has a 1" diameter tube, a T5 fluorescent lamp has a ⅝" diameter tube and a T12 fluorescent lamp has a 1½" diameter tube.)

Similar to a conventional fluorescent lamp, when one or more solid-state lighting arrays are placed within a T8 tube or a similar hollow member, each of the solid-state lighting arrays receives power from the pins on the end caps sealing the hollow member. The end caps used on a solid-state T8 tube or similar hollow member should provide adequate protection for the hollow member and permit outgassing from the solid-state devices forming the lighting arrays, while electrically coupling the solid-state lighting arrays to the conductive pins or other conductive features by which power is routed to the solid-state lighting arrays.

Figure 1B:
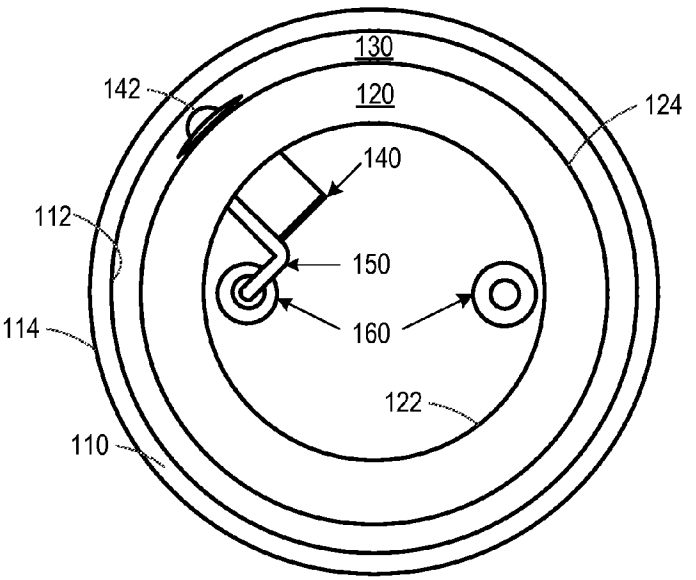
FIG. 1B is an end elevation of the illustrative end cap depicted in FIG. 1A, in accordance with an embodiment of the present disclosure.
Figure 1A:
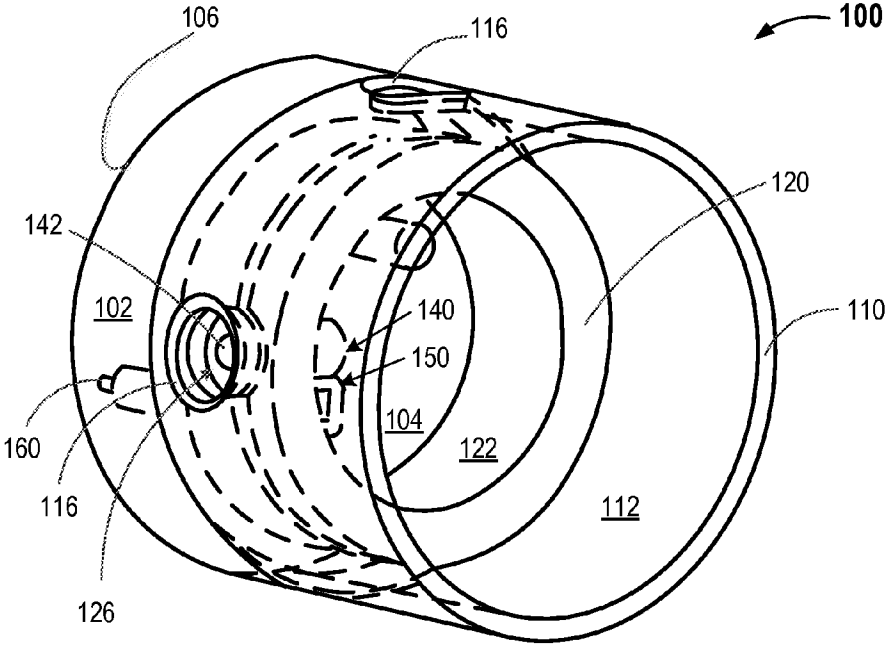
FIG. 1A is a perspective view of an illustrative end cap for use with a solid-state lighting device having a hollow tubular member, in accordance with an embodiment of the present disclosure.
Figure 1D:
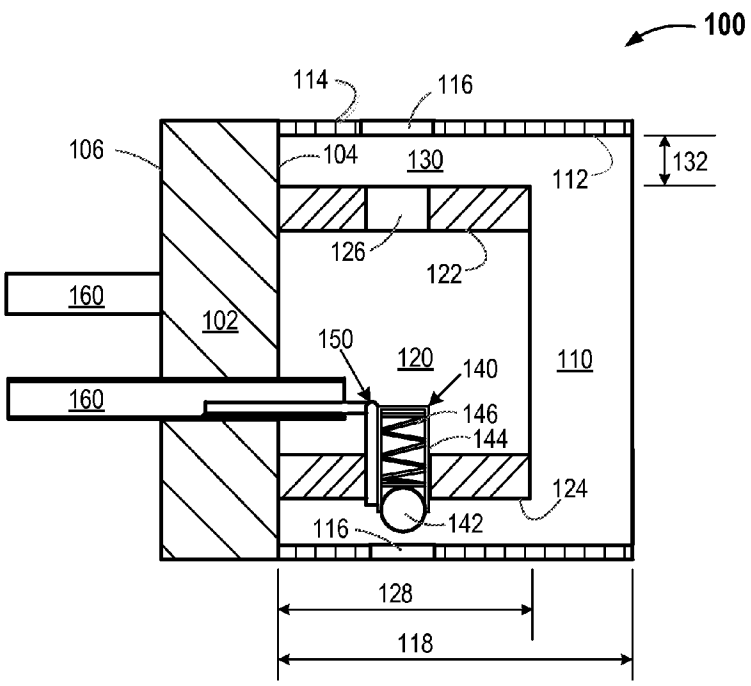
FIG. 1D is a cross-sectional elevation of the illustrative end cap depicted in FIGS. 1A, 1B, and 1C in accordance with an embodiment of the present disclosure.
Figure 1C:
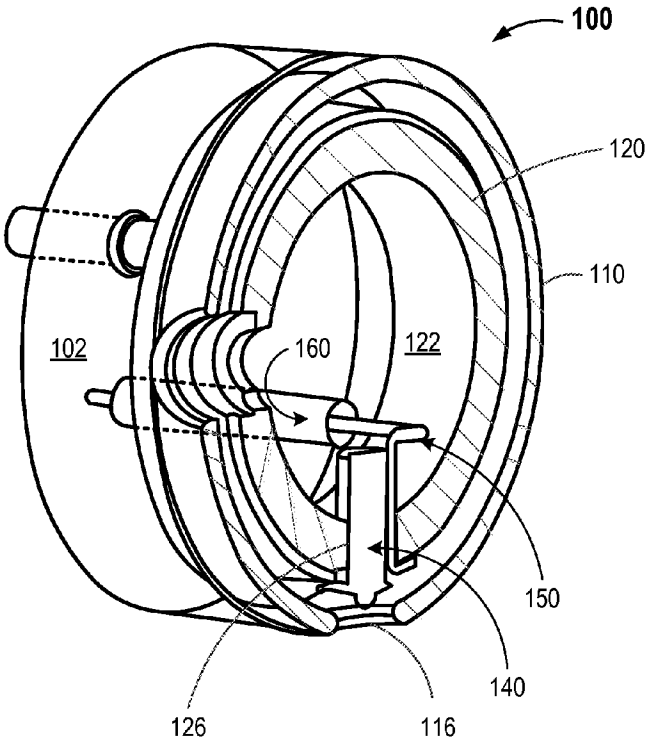
FIG. 1C is a cross sectional perspective of the illustrative end cap depicted in FIGS. 1A and 1B, in accordance with an embodiment of the present disclosure.

FIG. 1A provides a perspective of an illustrative end cap 100 useful for a solid-state lighting device, in accordance with at least one embodiment of the present disclosure. FIG. 1B provides an end elevation along a longitudinal axis of the illustrative end cap 100 depicted in FIG. 1A. FIG. 1C provides a perspective sectional of the illustrative end cap 100 depicted in FIG. 1A. The end cap 100 includes a base 102 having an inward-facing first side 104 and an outward-facing second side 106. The base 102 can include one or more metallic, non-metallic, or combination of metallic and non-metallic materials. In embodiments, the base 102 may have a generally cylindrical geometry with a diameter of from about 0.25 inches to about 4 inches. In some implementations, the base 102 can be a right circular cylindrical object having a diameter of about five-eighths of an inch (⅝"), similar to the diameter of a conventional T5 fluorescent lamp tube. In some implementations, the base 102 can be a right circular cylindrical object having a diameter of about one inch (1"), similar to the diameter of a conventional T8 fluorescent lamp tube. In some implementations, the base 102 can be a right circular cylindrical object having a diameter of about one and one-half inches (1½"), similar to the diameter of a conventional T12 fluorescent lamp tube.

An outer wall 110 extends a first distance 118 from the first side 104 and an inner wall 120 extends a second distance 128 from the first side 104. The outer wall 110 defines an inside surface 112 and an outside surface 114. The inner wall 120 defines an inside surface 122 and an outside surface 124. In embodiments, either or both the outer wall 110 and the inner wall 120 may be positioned along a common axis, for example the longitudinal axis of the base 102. In at least one embodiment, the outer wall 110 and the inner wall 120 may be positioned concentric with the longitudinal axis of the base 102. The inside diameter of the outer wall 110 (i.e., the diameter of the inside surface 112 of the outer wall 110) is greater than the outside diameter of the inner wall 120 (i.e., the diameter of the outside surface 124 of the inner wall 120) such that a gap 130 is formed between the outer wall 110 and the inner wall 120. The gap 130 may extend partially or completely to the base 102. The gap 130 may have a width 132 of from about 0.01 inches (0.25 mm) to about 0.25 inches (6.2 mm).

In some instances, at least the inside surface 112 of the outer wall 110 and the outside surface 124 of the inner wall may form an angle of 90° with (i.e., are perpendicular to) the first side 104 of the base 102. In such instances, the outer wall 110 and the inner wall 120 may be uniformly separated by a gap 130 having a constant width 132 throughout its extent. In other instances, either or both of the inside surface 112 of the outer wall 110 and the outside surface 124 of the inner wall may form an angle of other than 90° to the first side 104 of the base 102. In such instances, the gap 130 may have a tapering width 132 throughout its extent. For example, the width 132 of the gap 130 may decrease with depth (i.e., as you travel deeper into the gap 130 towards the first side 104 of base 102). Such tapering may provide a friction fit for a hollow member inserted into the end cap 100. In embodiments where the outer wall 110 and the inner wall 120 are cylindrical and arranged concentric with the longitudinal axis of the base 102, the gap 130 may assume an annular shape. In other embodiments, the gap 130 may assume any shape dependent upon the configuration of the outer wall 110 and the inner wall 120. For example, if the outer wall 110 and the inner wall 120 are oval in shape, an oval gap 130 is formed; if the outer wall 110 and the inner wall 120 are n-sided polygons, an n-sided polygonal gap 130 is formed.

In embodiments, the outer wall 110 may be formed separate from the base 102 and may be affixed to the base 102 using one or more fasteners, adhesives, thermal welds, chemical welds, or combinations thereof. In other embodiments, the outer wall 110 may be formed integral with the base, for example by casting, stamping, three-dimensional printing, or combinations thereof. In some instances, the inner wall 120 may be formed separate from the base 102 and may be affixed to the base 102 using one or more fasteners, adhesives, thermal welds, chemical welds, or combinations thereof. In other instances, the inner wall 120 may be formed integral with the base, for example by casting, stamping, three-dimensional printing, or combinations thereof.

Although the outer wall 110 and the inner wall 120 are depicted as having different thicknesses in FIGS. 1A, 1B, 1C, and 1D, in at least some embodiments, the outer wall 110 and the inner wall 120 may have the same thickness. In some instances, the outer wall 110 may have a greater thickness than the inner wall 120. Although the outer wall 110 is depicted in FIGS. 1A, 1B, 1C, and 1D as projecting a first distance 118 that is greater than the second distance 128 that the inner wall 120 projects from the first side 104 of the base 102, in some implementations the first distance 118 and the second distance 128 may be the same (i.e., the outer wall 110 and the inner wall 120 project the same distance from the first side 104 of the base 102). In other implementations, the second distance 128 may be greater than the first distance 118 (i.e., the inner wall 120 projects a greater distance from the first side 104 of the base 102 than the outer wall 110).

A number of apertures 126 may extend partially or completely through the inner wall 120. In embodiments, a contactor 140 may occupy at least one of the apertures 126. Although an illustrative Vlier pin (VLIER® Inc., Hopkinton, Mass.), spring loaded ball contactor 140 is depicted in FIGS. 1A, 1B, 1C, and 1D, any similar current or future developed tensioned or compressed contactor 140 capable of exerting a force extending outward from the outside surface 124 of the inner wall 120 towards the inside surface 112 of the outer wall 110 may be substituted. In at least some implementations, some or all of the number of apertures 126 may extend radially outward from the longitudinal axis of the end cap 100. In one embodiment, two apertures 126 extend completely through the inner wall 120.

A number of apertures 116 may extend completely through the outer wall 110. Some or all of the number of apertures 116 in the outer wall 110 may be aligned with respective apertures 126 in the inner wall 120. In such embodiments, each of some or all of the number of apertures 116 may be coaxially located along a common axis shared with a corresponding one of the number of apertures 126 (and contactors 140) in the inner wall 120. In embodiments, at least one of the coaxially aligned apertures 116 may be used to insert the contactor 140 into the respective aperture 126 in the inner wall 120.

The contactor 140 can include any number or combination of systems and devices capable of providing an electrically conductive path from a contact element 142 to a conductive member 160 projecting from the second side 106 of the base 102 via one or more conductors 150. In embodiments, the contactor 140 may include a contact element 142, such as a spherical, ovoid or ball shaped contact element 142, disposed in a hollow, closed-ended, tube 144. A tensioner 146, such as a spring, is compressed between the contact element 142 and the closed-end of the hollow tube 144 such that an axial force is exerted against the contact element 142 to maintain the contact element proximate an open end of the hollow tube 144. Although a spherical contact element 142 is depicted in FIG. 1D, any number, size, shape, or configuration of contact element(s) 142 may be similarly employed.

A conductive member or conductor 150 electrically couples the contact element 142 to a conductive member 160 that projects from the second side 106 of the base 102. In some instances, the contactor 140 may be friction fitted in the aperture 126, trapping the conductor 150 between the contactor 140 and the aperture 126 such that the contactor 140 electrically couples to the conductor 150 via physical and electrical contact with the hollow tube 144. In other instances, the conductor 150 may be trapped by one or more apertures, detents, or similar receiving and/or affixing devices positioned either internal or external to the contactor 140 such that the contactor 140 electrically couples to the conductor 150 via physical and electrical contact with the hollow tube 144. In yet other instances the conductor 150 may be physically and electrically affixed to the contactor 140, for example via solder, such that the contactor 140 electrically couples to the conductor 150 via the hollow tube 144.

Although only one contactor is depicted in FIGS. 1A, 1B, 1C, and 1D for clarity and ease of discussion, one or more additional contactors 140 may be disposed in end cap 100. For example, the use of a second contactor 140 may facilitate the installation of electrical supply and return paths using a single end cap 100. The use of a second contactor 140 may permit the installation of dual electrical supply or return paths using a single end cap 100. In some instances, the use of a second contactor 140 may permit the use of a first solid-state lighting array and a second solid-state lighting array in a single solid-state lighting device. In some instances, the first solid-state lighting array may extend in parallel with the second solid-state lighting array through the entire solid-state lighting device. In some instances, an electrical supply and return for a first solid-state lighting array may be positioned at a first end of the solid-state lighting device and an electrical supply and return for a second solid-state lighting array may be positioned at a second end of the solid-state lighting device.

In embodiments, one or more conductive members 160 may extend from the second side 106 of the base 102. The one or more conductive members 160 may provide an electrically continuous path from the contactor 140 to an external power distribution system. Although depicted as hollow in FIG. 1D, the conductive member 160 may be partially or completely solid. The conductive member 160 electrically couples to the conductor 150. In some instances, the conductor 150 may be friction fitted, for example by crimping, into a hollow portion or cavity formed in the conductive member 160. In other instances, the conductor 150 may be affixed, for example by soldering, to a portion of the interior or exterior of the conductive member 160.

Figure 2:
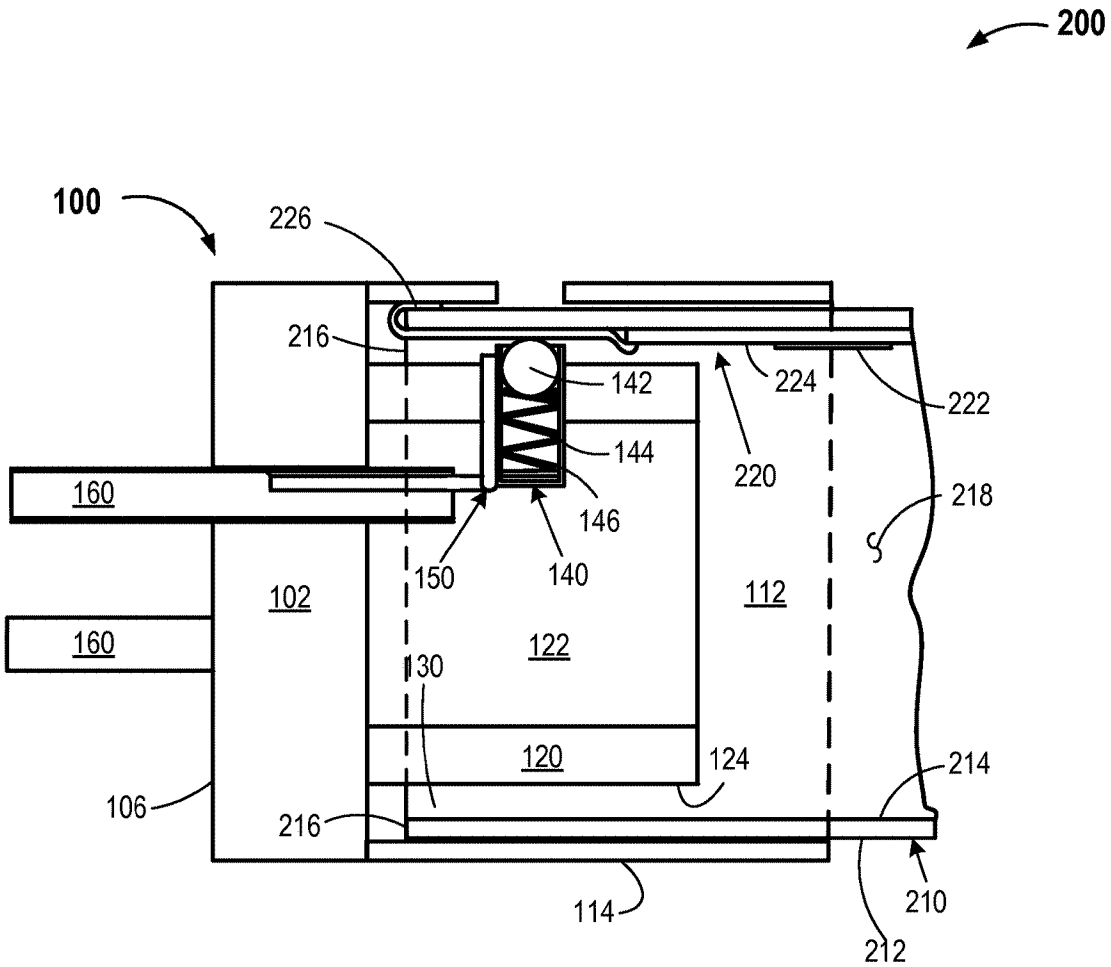
FIG. 2 is a cross sectional elevation of a solid-state lighting device that includes a hollow tubular member containing at least one solid-state lighting array disposed on a flexible substrate inserted into the end cap depicted in FIGS. 1A, 1B, 1C, and 1D in accordance with at least one embodiment of the present disclosure.

FIG. 2 illustrates an example solid-state lighting device 200 in which an end cap 100 receives a hollow member 210 that contains a solid-state emitter array 220, in accordance with one or more aspects of the present disclosure. In embodiments, the hollow member 210 includes a continuous wall that forms and surrounds an interior space 218. The hollow member 210 includes at least a first open end that defines a first peripheral edge 216. In implementations, the hollow member 210 may include a second open end that defines a second peripheral edge (not shown in FIG. 2). In some embodiments, the hollow member 210 may include a straight, cylindrical, hollow member similar to a conventional fluorescent light tube (e.g., a 1 inch diameter T8 fluorescent tube). In other implementations, the hollow member 210 may have any shape, size or configuration. For example, the hollow member 210 may have a "U" shape, a helical, or a double-helical shape, a circular shape, or any other shape, geometry, or configuration. The hollow member 210 may be a hollow cylinder, a hollow oval, or a hollow n-sided trapezoidal or polygonal member.

In some instances, the hollow member 210 may include a hollow glass member. In other instances, the hollow member 210 may include a hollow plastic or polymeric member, for example a hollow polycarbonate member. In some instances, the hollow member 210 may be optically transparent. In other instances, the hollow member 210 may be optically translucent. The hollow member 210 may include one or more diffusers or diffraction devices to more evenly distribute the light produced by the solid-state emitter array 220. In some instances, one or more reflective devices may be disposed in whole or in part in, on, or about the hollow member 210 to direct the light produced by the solid-state emitter array 220 in one or more desired directions. In embodiments, one or more light diffusive coatings may be applied to the outside surface 212, the inside surface 214, or both the outside and inside surfaces 212, 214 of the hollow member 210.

The gap 130 in the end cap 100 receives the first peripheral edge 216 of the first open end of the hollow member 210. In some instances, the first peripheral edge 216 of the hollow member 210 may be slideably inserted into the gap 130 in the end cap 100. A non-hermetic seal between the hollow member 210 and the end cap 100 may be provided when the hollow member 210 is inserted or otherwise seated in the gap 130. In embodiments, a non-hermetic seal between the end cap 100 and the hollow member 210 provides the ability for outgassing of solid-state emitters 222 forming the solid-state emitter arrays 220. In some embodiments, one or more adhesives or similar chemical bonding agents may be used to affix the end cap 100 to the hollow member 210. In some instances, a taper in the gap 130 may provide a friction fit between the end cap 100 and either or both of the outside surface 212 and inside surface 214 of the hollow member 210. In some instances, the hollow member 210 may be wholly or partially affixed to the end cap 100 via one or more contactors 140 that are received by a detent or a similar construction on the inside surface 214 of the hollow member 210. In instances where a contactor 140 retains the hollow member 210, the respective contactor 140 may or may not be used to deliver power to or receive power from the solid-state emitter array 220.

Any number or combination of solid-state emitter arrays 220 may be disposed in whole or in part within the hollow member 210. The solid-state emitter array 220 may include any number or combination of solid-state emitters 222 that are formed, affixed, or attached to a substrate 224. The solid-state emitter array 220 may include any number of semiconductor emitters 222 capable of producing or emitting electromagnetic radiation. In some instances, the solid-state emitter array 220 may include any number of semiconductor emitters 222 capable of producing or emitting electromagnetic radiation at wavelengths perceptible to humans—i.e., semiconductor devices capable of producing or emitting visible light at one or more wavelengths between about 390 nanometers (nm) and about 700 nm. Non-limiting examples of visible light producing semiconductor emitters 222 include light emitting diodes (LEDs), organic light emitting diodes (OLEDs), and polymer light emitting diodes (PLEDs).

In some instances, the solid-state emitter array 220 may include any number of semiconductor emitters 222 capable of producing or emitting electromagnetic radiation at one or more wavelengths imperceptible to humans—i.e., semiconductor devices capable of producing or emitting electromagnetic radiation at wavelengths of less than about 390 nm or greater than about 700 nm. Non-limiting examples of non-visible light producing semiconductor emitters 222 include infrared LEDs, near-infrared LEDs, ultraviolet LEDs, and near-ultraviolet LEDs. In some implementations, a solid-state emitter array 220 producing or emitting electromagnetic radiation at wavelengths imperceptible to humans may be inserted into a hollow member 210 that includes, in part or in whole, one or more materials or coatings capable of producing or providing a visible light output when exposed to the electromagnetic radiation produced or emitted by the solid-state emitter array 220.

The substrate 224 carries at least a portion of the solid-state emitter arrays 220. In some instances, the substrate 224 may include one or more flexible materials, for example polyethylene terephthalate ("PET"). In embodiments, the substrate 224 may include a light-colored or other highly reflective material, for example white PET. In some instances, the substrate 224 may include a laminated structure having one or more flexible conductors 226 disposed between two layers. A flexible substrate 224 may facilitate inserting the solid-state emitter array 220 into the hollow member 210.

The one or more flexible conductors 226 electrically couples some or all of the solid-state emitter arrays 220 to the contactor 140. In embodiments, the one or more flexible conductors 226 may extend from an end of the substrate 224 proximate the first end of the hollow member 210. In embodiments, the one or more flexible conductors 226 may extend from an end of the substrate 224 proximate the second end of the hollow member 210. In embodiments, the contactor 140 traps the one or more flexible conductors 226 extending from the substrate 224 against the substrate 224 or the inside surface 214 of the hollow member 210. In such instances, the tensioner 146 (e.g., a Vlier pin spring or similar force-producing device) forces the contact element 142 against the flexible conductor 226, forming an electrical coupling between the contactor 140 and the respective flexible conductor 226 when the hollow member 210 is inserted into the gap 130 in the end cap 100.

In embodiments, some or all of the one or more flexible conductors 226 may extend beyond the first peripheral edge 216 of the hollow member 210, may wrap around the first peripheral edge 216 and extend for a distance along the outside surface 212 of the hollow member 210 as depicted in FIG. 2. Wrapping some or all of the one or more flexible conductors 226 around the first peripheral edge 216 of the hollow member 210 may facilitate the establishment of the electrically conductive coupling between the contactor 140 and the respective flexible conductor 226 by holding the respective flexible conductor 226 in position as the hollow member 210 is slideably inserted into the gap 130 in the end cap 100.

Figure 4:
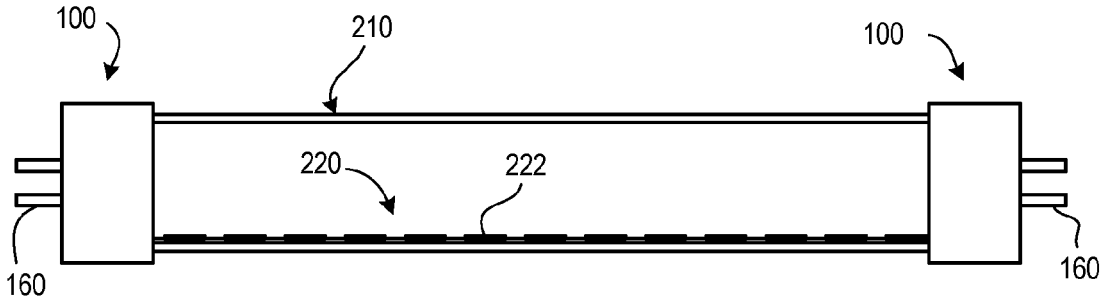
FIG. 4 is a side view of a solid-state lighting device with end caps installed at both ends in accordance with at least one embodiment of the present disclosure.

Although not depicted in FIG. 2, in some instances one or more flexible conductors 226 may extend from a second end of the substrate 224 and may be proximate the inside surface 214 of the hollow member 210 at the second peripheral edge of the hollow member 210. In such instances, each of the one or more contactors 140 in the end cap 100 proximate the second peripheral edge of the hollow member 210 electrically couples a respective conductive member 160 to a respective flexible conductor 226 extending from the second end of the substrate 224. In embodiments, some or all of the one or more flexible conductors 226 may extend beyond the second peripheral edge of the hollow member 210, may wrap around the second peripheral edge and extend for a distance along the outside surface 212 of the hollow member 210. (FIG. 4 shows an embodiment with end caps 100 installed at both peripheral edges of hollow member 210.)

Figure 3:
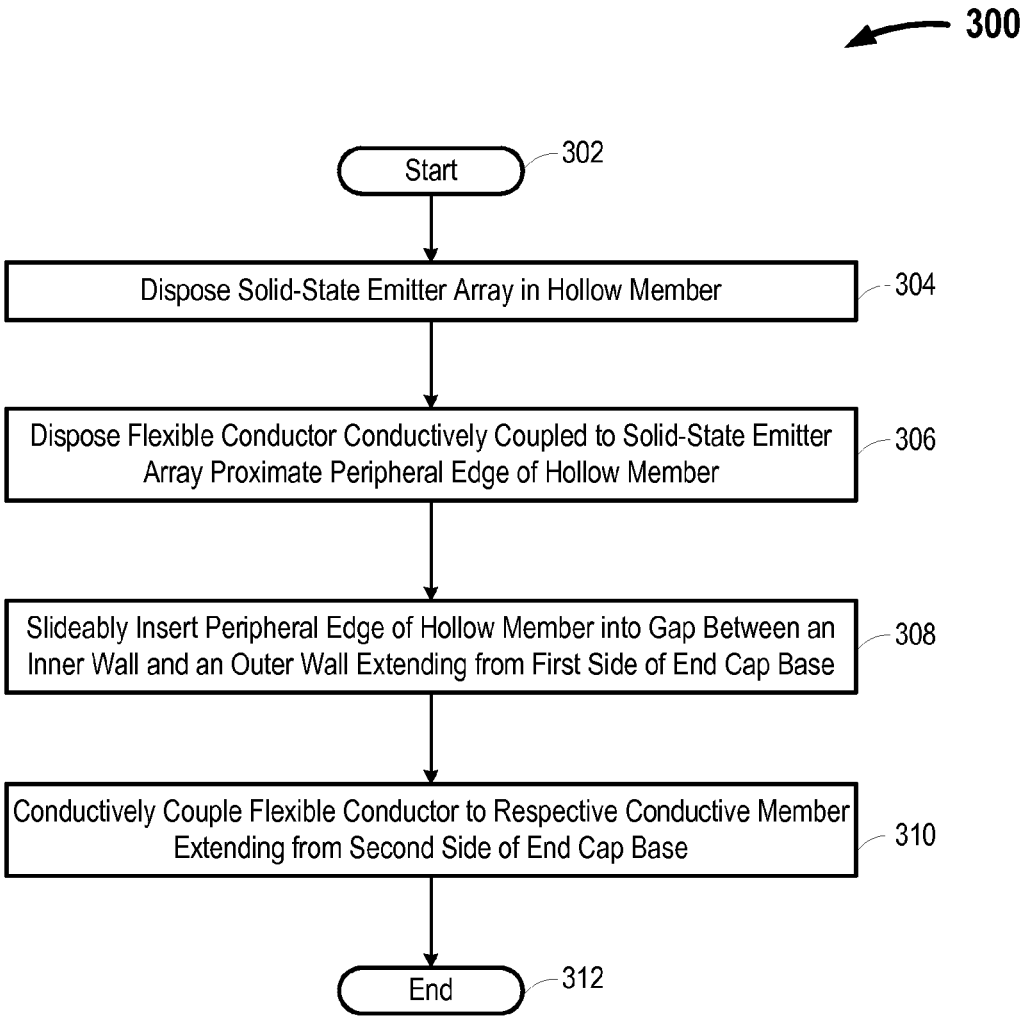
FIG. 3 is a high-level logic flow diagram of an illustrative method of providing a solid-state lighting device that includes a hollow tubular member containing at least one solid-state lighting array disposed on a flexible substrate inserted into the end cap as depicted in FIG. 2, in accordance with at least one embodiment of the present disclosure.

FIG. 3 is a high-level logic diagram of a method 300 of providing a solid-state lighting device such as the solid-state lighting device 200 described in detail with regard to FIG. 2, in accordance with one or more aspects of the present disclosure. The method commences at 302.

At 304, a substrate 224 that includes at least one solid-state emitter array 220 is disposed in whole or in part in the interior space 218 of a hollow member 210. In embodiments, at least a portion of the substrate 224 may be disposed proximate an inside surface 214 of the hollow member 210. In embodiments, the hollow member 210 includes at least a first open end that forms a first peripheral edge 216 and may include a second open end that forms a second peripheral edge. One or more flexible conductors 226 electrically coupled to some of all of the at least one solid-state array 220 may extend from the first end of the substrate 224 proximate the first peripheral edge 216 of the hollow member 210. In embodiments, one or more flexible conductors 226 may extend from the second end of the substrate 224 proximate the second peripheral edge of the hollow member 210.

At 306, the at least one flexible conductor 226 extending from the first end of the substrate 224 is disposed proximate the inside surface 214 of the hollow member 210. In embodiments, the at least one flexible conductor 226 may extend to the first peripheral edge 216 of the hollow member 210. In other embodiments, the at least one flexible conductor 226 may extend beyond the first peripheral edge 216 of the hollow member 210. In such embodiments, the at least one flexible conductor 226 may wrap around the first peripheral edge 216 of the hollow member 210. Further, in such embodiments, the at least one flexible conductor 226 may extend for a distance along the outside surface 212 of the hollow member 210.

In embodiments, the at least one flexible conductor 226 extending from the second end of the substrate 224 is disposed proximate the inside surface 214 of the hollow member 210. In some instances, the at least one flexible conductor 226 may extend to the second peripheral edge of the hollow member 210. In other instances, the at least one flexible conductor 226 may extend beyond the second peripheral edge of the hollow member 210. In such instances, the at least one flexible conductor 226 may wrap around the second peripheral edge of the hollow member 210. Further, in such instances, the at least one flexible conductor 226 may extend for a distance along the outside surface 212 of the hollow member 210.

At 308, the first peripheral edge 216 of the hollow member 210 is slideably inserted into the gap 130 formed by the inside surface 112 of the outer wall 110 extending from the first side 104 of the base 102 of the end cap 100 and the outside surface 124 of the inner wall 120 extending from the first side 104 of the base 102 of the end cap 100.

In embodiments, the second peripheral edge of the hollow member 210 may be slideably inserted into the gap 130 formed by the inside surface 112 of the outer wall 110 extending from the first side 104 of the base 102 of a second end cap 100 and the outside surface 124 of the inner wall 120 extending from the first side 104 of the base 102 of the second end cap 100.

At 310, the at least one flexible conductor 226 extending from the first end of the substrate 224 is electrically coupled to a conductive member 160 extending from a second side 106 of the base 102 of the end cap 100. In embodiments, a contactor 140 electrically coupled the at least one flexible conductor 226 to the conductive member 160. The contactor 140 may be disposed in whole or in part in the inner wall 120 of the end cap 100 and a contact element 142 may exert a force directed outward from the outside surface 124 of the inner wall 120 that traps the at least one flexible conductor 226 between the contact element 142 and the substrate 224 or the inside surface 214 of the hollow member 210.

In embodiments, at least one flexible conductor 226 extending from a second end of the substrate 224 may be electrically coupled to a conductive member 160 extending from a second side 106 of a second end cap base 102. In embodiments, a contactor 140 electrically coupled the at least one flexible conductor 226 to the conductive member 160. The contactor 140 may be disposed in whole or in part in the inner wall 120 of the second end cap base 102 and a contact element 142 may exert a force directed outward from the outside surface 124 of the inner wall 120 that traps the at least one flexible conductor 226 between the contact element 142 and the substrate 224 or the inside surface 214 of the hollow member 210.

An end cap apparatus for use with a hollow member containing at least one solid-state emitter may include a base having a first side and an opposed second side. An outer wall having a perimeter, an inside surface, and an outside surface, the outer wall may extend a first distance from the first side of the base. An inner wall having a perimeter, an inside surface, and an outside surface, the inner wall may extend a second distance from the first side of the base A gap may be formed between the outside surface of the inner wall and the inside surface of the outer wall. The end cap apparatus may also include at least one contactor disposed at least partially in the inner wall. The at least one contactor may extend beyond the outside surface of the inner wall and may exert a force directed outwardly from the outside surface of the inner wall.

A solid-state lighting device may include a hollow member that has at least a first open end forming a first peripheral edge. The lighting device may further include at least one solid-state emitter disposed on a substrate. In embodiments, the substrate may be disposed proximate at least a portion of an interior surface of the hollow member. In embodiments, the substrate may include at least one flexible conductor disposed proximate the first open end of the hollow member. The solid-state lighting device may further include an end cap apparatus. The end cap apparatus may include a base having a first side and an opposed second side. An outer wall having a perimeter, an inside surface, and an outside surface, the outer wall may extend a first distance from the first side of the base. An inner wall having a perimeter, an inside surface, and an outside surface, the inner wall may extend a second distance from the first side of the base. A gap may be formed between the outside surface of the inner wall and the inside surface of the outer wall. The end cap apparatus may also include at least one contactor disposed at least partially in the inner wall. The at least one contactor may extend beyond the outside surface of the inner wall and may exert a force directed outwardly from the outside surface of the inner wall. The at least one contactor may electrically couple a conductive member on the second side of the end cap base to the at least one flexible conductor when the hollow member is received in the gap between the inner wall and the outer wall.

A solid-state lighting method may include disposing a substrate that includes at least one solid-state emitter in an interior space of a hollow member having at least a first open end that defines a first peripheral edge. The method may further include disposing at least one flexible conductor electrically coupled to the at least one solid-state emitter along a portion of an inside surface of the hollow member, proximate at least the first open end of the hollow member. The end cap and the hollow member may be joined or otherwise coupled by slideably inserting at least the first peripheral edge of the hollow member into a gap formed between an inside surface of an outer wall that extends from a first side of an end cap base and an outside surface of an inner wall that extends from the first side of the end cap base. Power may be supplied to the at least one solid-state emitter by electrically coupling each flexible conductor to a respective conductive member extending from a second side of the end cap base by trapping the flexible conductor between the inside surface of the hollow member and a respective contactor disposed at least partially in the inner wall extending from the end cap base.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. An end cap apparatus, comprising:

a base having a first side and an opposed second side;

an outer wall having an inside surface and an outside surface, the outer wall extending a first distance from the first side of the base;

an inner wall having an inside surface and an outside surface, the inner wall extending a second distance from the first side of the base and spaced inward of the outer wall to define a gap therebetween; and at least one contactor disposed at least partially in the inner wall, the at least one contactor extending beyond the outside surface of the inner wall and being capable of exerting a force directed outwardly from the outside surface of the inner wall;

wherein:

the outer wall has at least one aperture that is coaxially aligned with the at least one contactor; and the at least one contactor comprises a plurality of contactors and the at least one aperture comprises a corresponding plurality of apertures, each of the plurality of apertures being coaxially aligned with a respective one of the plurality of contactors.

2. The end cap apparatus of claim 1, further comprising:

at least one conductive member extending a distance from the second side of the base, the at least one conductive member being electrically coupled to the at least one contactor.

3. The end cap apparatus of claim 1 wherein the first distance the outer wall extends from the first side of the base is greater than the second distance the inner wall extends from the first side of the base.

4. The end cap apparatus of claim 1 wherein at least a portion of the outside surface of the inner wall is spaced a fixed distance from a corresponding portion of the inside surface of the outer wall such that the gap between the outside surface of the inner wall and the inside surface of the outer wall remains constant.

5. The end cap apparatus of claim 4 wherein the outer wall extends perpendicularly from the first side of the base; and wherein the inner wall extends perpendicularly from the first side of the base.

6. The end cap apparatus of claim 5 wherein the outer wall comprises an open-ended cylindrical member and the inside surface of the outer wall is at a fixed first radius; and wherein the inner wall comprises an open-ended cylindrical member and the outside surface of the inner wall is at a fixed second radius, the second radius being less than the first radius; and wherein the difference between the first radius and the second radius defines a width of the gap between the outer wall and the inner wall.

7. The end cap apparatus of claim 1 wherein the at least one contactor comprises a mechanical contactor that includes:

a hollow body having a first end and a second end;

a slideably displaceable contact element trapped within the hollow body and extending at least partially from the first end of the hollow body; and a force-producing tensioner device trapped in the hollow body to allow a slideable displacement of the contact element into the hollow body and to cause the contact element to extend at least partially beyond the hollow body.

8. A solid-state lighting device, comprising:

a hollow member having at least a first open end forming a first peripheral edge;

at least one solid-state emitter disposed on a substrate, the substrate disposed proximate at least a portion of an interior surface of the hollow member, the substrate including at least one flexible conductor disposed proximate the first open end of the hollow member; and at least one end cap apparatus, comprising:

a base having a first side and an opposed second side;

an outer wall having an inside surface and an outside surface, the outer wall extending a first distance from the first side of the base;

an inner wall having an inside surface and an outside surface, the inner wall extending a second distance from the first side of the base and spaced inward of the outer wall to define a gap therebetween, the first peripheral edge of the hollow tube being received in the gap; and at least one contactor disposed at least partially in the inner wall, the at least one contactor exerting a force directed outwardly from the outside surface of the inner wall and against the at least one flexible conductor, the at least one contactor electrically coupling a conductive member on the second side of the base to the at least one flexible conductor;

wherein the outer wall has at least one aperture that is coaxially aligned with the at least one contactor.

9. The solid-state lighting device of claim 8 wherein the substrate includes a plurality of flexible conductors, each of the plurality of flexible conductors spaced apart from any other flexible conductor and positioned along a respective portion of the interior surface of the hollow member.

10. The solid-state lighting device of claim 8 wherein the hollow member comprises at least one of: a transparent hollow member or a translucent hollow member.

11. The solid-state lighting device of claim 8 wherein the at least one solid-state emitter comprises an array of visible light-emitting semiconductor devices and the substrate comprises a flexible substrate.

12. The solid-state lighting device of claim 11 wherein the array of visible light-emitting semiconductor devices comprises an array of LEDs.

13. The solid-state lighting device of claim 8 wherein the at least one solid-state emitter is selected from a light emitting diode (LED); an organic light emitting diode (OLED); or a polymer light emitting diode (PLED).

14. The solid-state lighting device of claim 8 wherein the hollow member comprises the first open end having the first peripheral edge and a second open end having a second peripheral edge;

wherein the substrate includes at least one flexible conductor positioned along an interior surface at the first open end of the hollow member and at least one flexible conductor positioned along the interior surface at the second open end of the hollow member; and wherein the at least one end cap apparatus includes first and second end cap apparatuses, the first peripheral edge of the hollow member being received in the gap of the first end cap apparatus whereby the contactor of the first end cap apparatus is electrically coupled to the at least one flexible conductor positioned along an interior surface at the first open end of the hollow member, and the second peripheral edge of the hollow member being received in the gap of the second end cap apparatus whereby the contactor of the second end cap apparatus is electrically coupled to the at least one flexible conductor positioned along the interior surface at the second open end of the hollow member.

15. The solid-state lighting device of claim 8 wherein the at least one contactor comprises a plurality of contactors and the at least one aperture comprises a corresponding plurality of apertures, each of the plurality of apertures being coaxially aligned with a respective one of the plurality of contactors.

* * * * *